US005794546A

United States Patent [19]

Carter

[11] Patent Number: 5,794,546

[45] Date of Patent: Aug. 18, 1998

[54] COLLAPSIBLE DISPLAY TABLE

[76] Inventor: Mark C. Carter, 10131 Kernwood Ct., Alta Loma, Calif. 91737

[21] Appl. No.: 883,720

[22] Filed: Jun. 27, 1997

Related U.S. Application Data

[63] Continuation of Ser. No. 671,088, Jun. 27, 1996, abandoned, which is a continuation of Ser. No. 191,660, Feb. 4, 1994, abandoned.

[51] Int. Cl.[6] ..... A47B 3/00

[52] U.S. Cl. ..... 108/115; 108/166

[58] Field of Search ..... 108/166, 169, 108/170, 117, 115, 118, 123, 162, 173, 174, 175, 178; 248/164, 166, 436, 440, 188.1

[56] References Cited

U.S. PATENT DOCUMENTS

| | | | |
|---|---|---|---|
| 490,991 | 1/1893 | Smith | 108/115 X |
| 1,263,717 | 4/1918 | Stone | 108/115 X |
| 1,879,087 | 9/1932 | Chomik | 108/157 |
| 2,644,590 | 7/1953 | Baxter | 108/115 X |
| 2,936,896 | 5/1960 | Friedman | 108/166 X |
| 2,987,362 | 6/1961 | Bernath | 108/157 X |
| 3,462,773 | 8/1969 | Triplett | 108/115 X |
| 4,607,656 | 8/1986 | Carter . | |
| 5,131,547 | 7/1992 | Goldberg | 108/166 X |

FOREIGN PATENT DOCUMENTS

| | | | |
|---|---|---|---|
| 511350 | 12/1920 | France | 108/115 |
| 741098 | 2/1933 | France . | |
| 1296014 | 5/1962 | France . | |
| 2678813 | 1/1993 | France . | |
| 211143 | 6/1909 | Germany . | |
| 495572 | 3/1930 | Germany . | |
| 2334393 | 1/1975 | Germany . | |
| 3619481 | 12/1987 | Germany . | |
| 425540 | 10/1982 | Sweden . | |
| 423130 | 4/1967 | Switzerland . | |
| 10159 | of 1911 | United Kingdom . | |
| 4872 | of 1913 | United Kingdom . | |
| 191882 | 6/1923 | United Kingdom | 108/115 |
| 464496 | 7/1935 | United Kingdom . | |
| 466632 | 6/1937 | United Kingdom | 108/115 |
| 501952 | 3/1939 | United Kingdom . | |
| 8600206 | 1/1986 | WIPO . | |

*Primary Examiner*—Jose V. Chen

*Attorney, Agent, or Firm*—Fulwider Patton Lee & Utecht, LLP

[57] ABSTRACT

The collapsible display table includes a collapsible truss framework that supports a folding table top and one or more folding utility shelves. The two link members in each truss pair of the framework are pivotally connected together in a scissors configuration so as to be extendable horizontally from a first collapsed position to a second extended position. A pair of table top support arms pivotally connected to the top of the framework on opposite sides are provided for supporting the table top, and at least one pair of shelf support arms is removably attachable between adjacent legs on opposite sides for supporting a lower shelf. The legs of the collapsible display table preferably include telescoping foot extensions. The table top and lower utility shelf are preferably made of a plurality of segments hingedly connected together, allowing them to be foldable. In an alternate embodiment, the truss framework includes multiple truss pairs of link members pivotally connected together in a scissors configuration.

5 Claims, 8 Drawing Sheets

FIG. 7
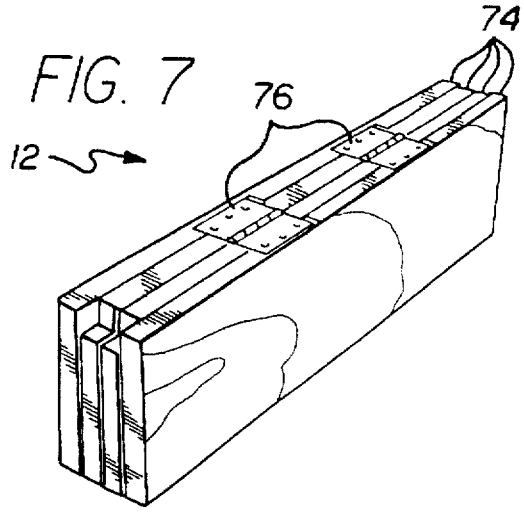
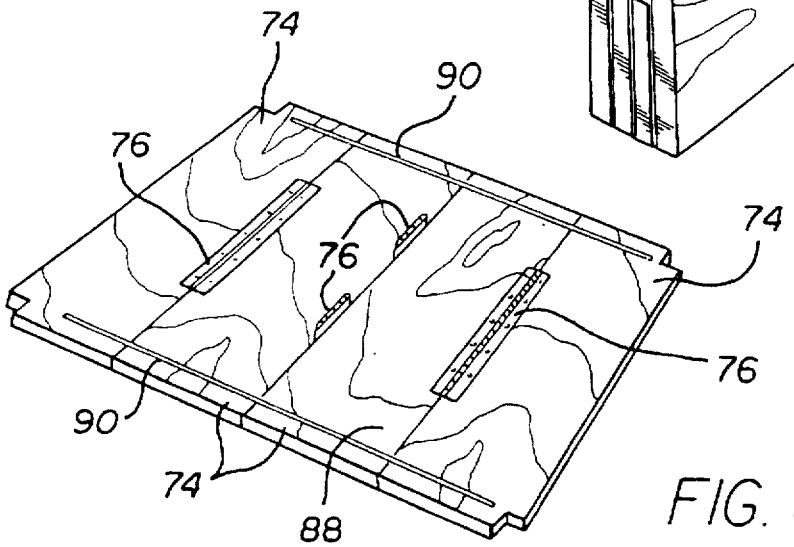
FIG. 8
FIG. 9
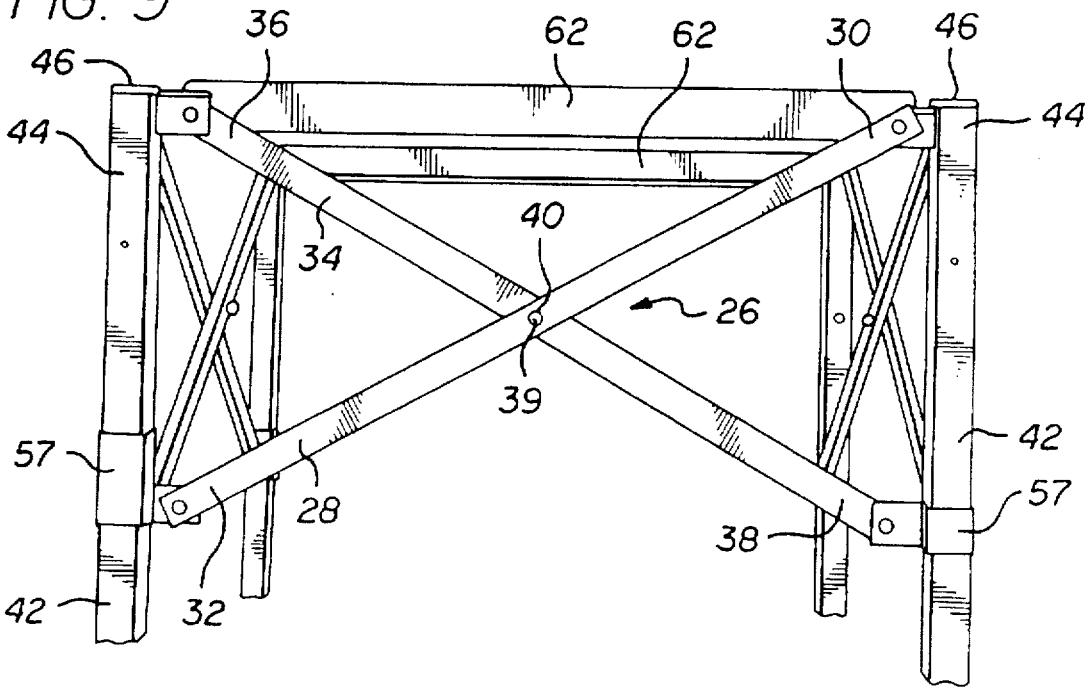

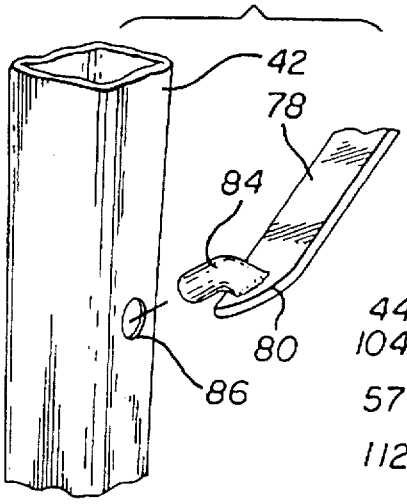
FIG. 13
FIG. 15
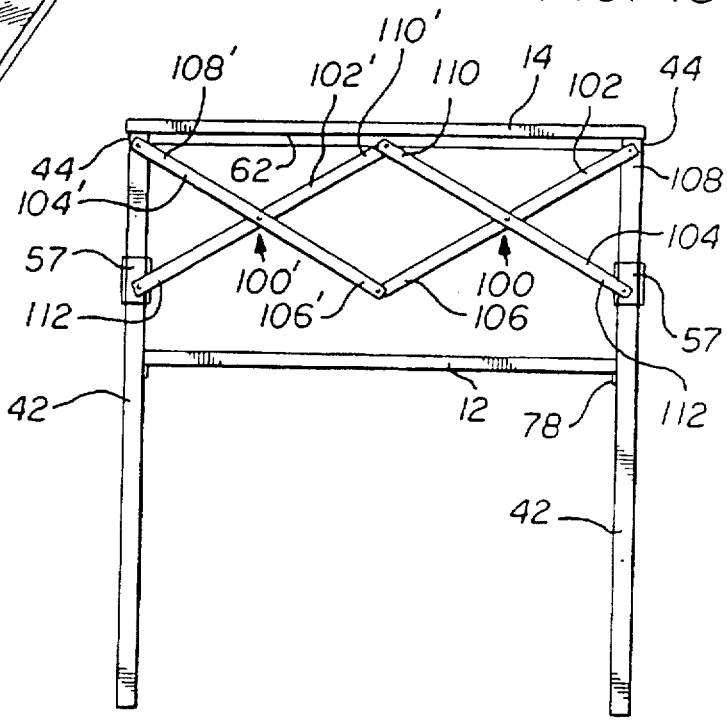
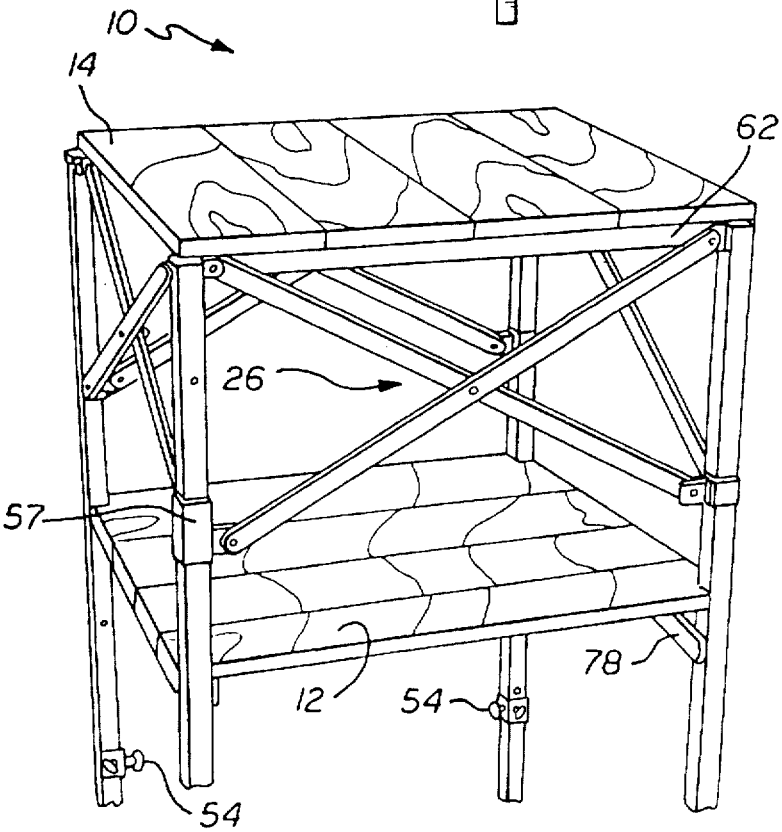
FIG. 14

FIG. 21
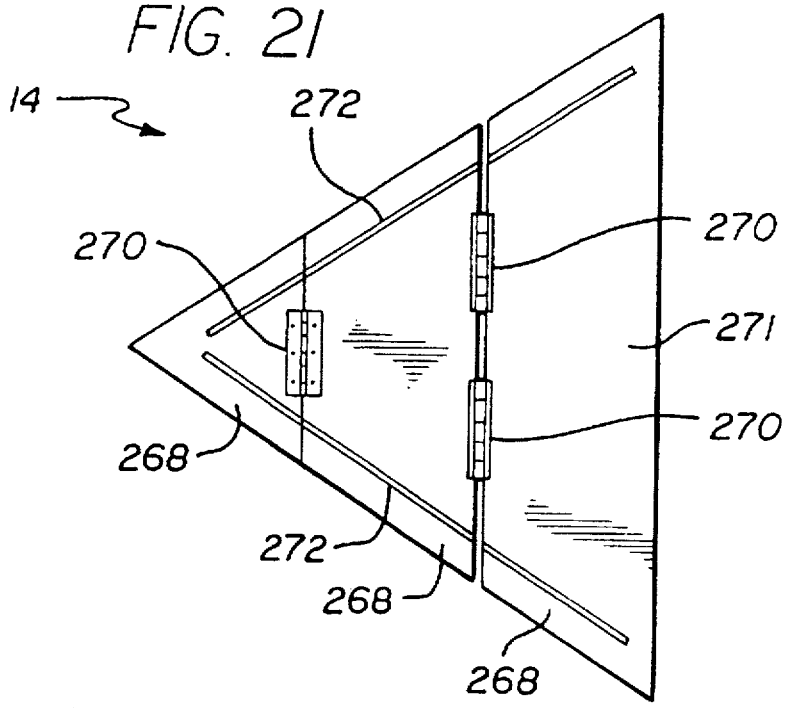
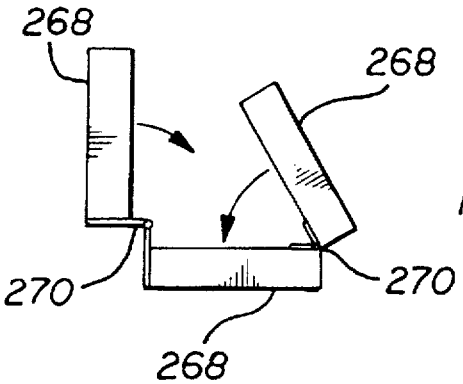
FIG. 20
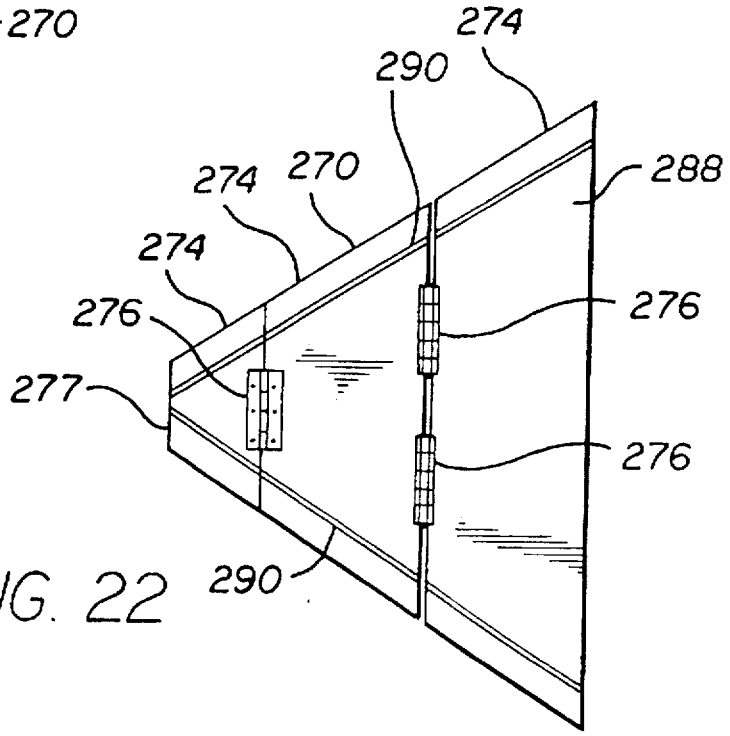
FIG. 22

COLLAPSIBLE DISPLAY TABLE

This application is a continuation of application Ser. No. 08/671,088 filed Jun. 27, 1996 now abandoned which is a continuation of application Ser. No. 08/191,660 filed Feb. 4, 1994 now abandoned.

BACKGROUND OF THE INVENTION

1. Field of the Invention

This invention relates generally to folding, collapsible structures, and more particularly relates to a collapsible display table having a truss framework, a folding table top and a folding utility shelf.

2. Description of Related Art

Folding card tables and heavy work tables having individual legs or pairs of legs that are pivotally connected to a table top to swing down from a concealed position to lock into a set up position are well known. The portability of such tables is generally limited by the size of the table top. The lighter card table style tables are generally not strong enough or stable enough to support modern video or computer types of displays that are currently used in travelling presentations. The heavier, folding work style tables are generally quite large and heavy, making them impractical for use as a portable display table in presentations, often requiring the use of a truck for transporting video or computer display equipment and appropriate display tables. The size and weight of video or computerized display equipment that can be supported on smaller, more readily portable display tables have also been generally limited. A display table offering one or more utility shelves would also be useful for providing an efficient use of space for display equipment, but conventional tables providing one or more utility shelves have also generally not been collapsible and easily portable.

It would therefore be desirable to provide an improved collapsible display table with a collapsible support framework. It would be further desirable to provide a collapsible display table that would provide greater strength and stability, to allow support of relatively large, heavy video display monitors, televisions, video or film display equipment, and the like. It would also be desirable to provide a collapsible display table offering one or more utility shelves, to offer a larger and more efficient use of space for accommodating display equipment. The present invention fulfills these needs.

SUMMARY OF THE INVENTION

Briefly, and in general terms, the present invention provides for an improved, collapsible display table with a collapsible truss framework that supports a folding table top and a folding utility shelf. The collapsible display table provides one or more utility shelves, to offer a larger and more efficient use of space for accommodating display equipment, and has improved strength and stability, to support relatively large, heavy video display monitors, and video or film display equipment, and the like.

The invention accordingly provides for a collapsible display table having a table top, a plurality of legs, and at least one truss pair of link members connected between adjacent legs. A first link member of each truss pair is connected at one end to the upper end of one leg, while the second link member is slidably and pivotally connected to the leg. The two link members in each truss pair are also pivotally connected together in a scissors configuration so as to be extendable horizontally from a first collapsed position to a second extended position. At least two table top support arms are provided, the first end of each of the table top support arms being pivotally connected to the upper end of one of the legs, and the second end of being removably attachable to the upper end of an adjacent one of the legs. The collapsible display table also includes a lower shelf and at least two shelf support arms that are removably attachable between adjacent legs for supporting the lower shelf. The legs of the collapsible display table preferably include telescoping foot extensions and means for fixing the foot extension in retracted and extended positions. The table top and lower utility shelf are preferably made of a plurality of segments hingedly connected together, allowing them to be foldable, and the table top and lower utility shelf preferably are provided with slots in their bottom surfaces for interfitting with corresponding support arms.

In alternate embodiments, adjacent legs of the collapsible display table can be connected and stabilized by multiple truss pairs of link members pivotally connected together in a scissors configuration so as to be extendable horizontally from a first collapsed position to a second extended position.

These and other aspects and advantages of the invention will become apparent from the following detailed description, and the accompanying drawing, which illustrates by way of example the features of the invention.

BRIEF DESCRIPTION OF THE DRAWINGS

FIG. 7 is a perspective view of the folding lower shelf in a folded configuration;

FIG. 8 is a plan view of the bottom surface of the folding lower shelf in an unfolded configuration;

FIG. 9 is an enlarged front perspective view of the upper portion of the legs and truss pair network of the collapsible display table;

FIG. 13 is an enlarged perspective view of a hole in a lower portion of a leg illustrating insertion of a prong at an end of a shelf support arm of the collapsible display table, taken from the inset portion 12 of FIG. 4;

FIG. 14 is a front perspective view of the upper portion of the collapsible display table with the table top and lower shelf in place;

FIG. 15 is a side elevational view of an alternate embodiment of a collapsible display table of the invention, with dual truss pairs of link members on each side of the collapsible display table;

FIG. 20 is a side elevational view of the triangular folding table top of the collapsible display table of FIG. 16 in a folded configuration;

FIG. 21 is a bottom plan view of the bottom surface of the folding table top of FIG. 20 in an unfolded configuration;

FIG. 22 is a bottom plan view of the bottom surface of the folding lower shelf of FIG. 16 in an unfolded configuration.

DETAILED DESCRIPTION OF THE PREFERRED EMBODIMENTS

The size and weight of video display equipment that can be supported on portable, collapsible card tables have been generally limited, and the portability of conventional heavier duty collapsible tables has been generally limited by weight. Conventional display tables providing for a utility shelf have also generally not been collapsible and easily portable. The improved collapsible display table of the invention provides for a strong and stable truss framework, as well as one or more utility shelves for additional video equipment for supporting display equipment suitable for making computer, video or film presentations, and the like.

Figure 1:
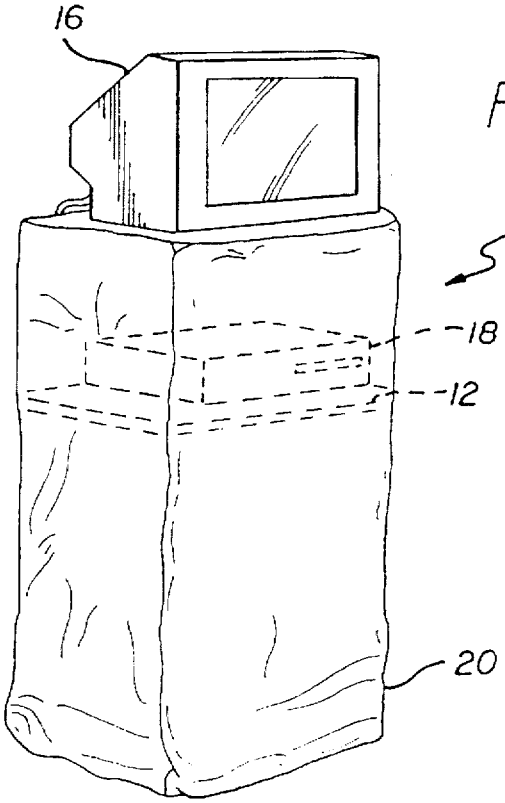
FIG. 1 is a front perspective view of shroud covering a collapsible display table according to the invention, with a display monitor resting on the top of the collapsible display table, and accessory equipment resting on the lower shelf of the collapsible display table, shown in phantom.
Figure 2:
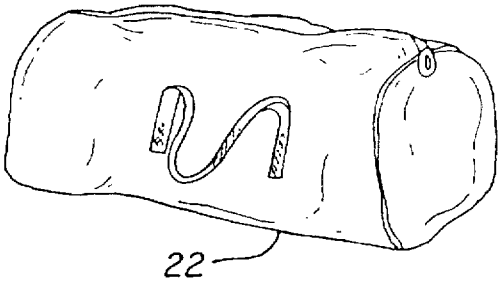
FIG. 2 is a perspective view of a duffle bag in which the collapsible display table can be transported in a folded configuration.

As is illustrated in the drawings, the invention is embodied in an improved collapsible display table 10, having a lower folding utility shelf 12, and a folding table top 14. The display table is suitable for use in supporting large and heavy display equipment, such as a video display monitor 16, which can be accommodated on the table top. The utility shelf is suitable for supporting accessory equipment, such as a video cassette player 18, computer, CD ROM player, film or slide supplies, and the like. As is illustrated in FIG. 1, the entire collapsible display table can also conveniently be covered, for example, with a fabric shroud 20 to conceal the accessory equipment on the utility shelf, and the structure of the collapsible display table. The table top, utility shelf, and the rest of the structure of the collapsible display table can be folded and disassembled for convenient transportation, such as in a duffle bag 22, for example, as is shown in FIGS. 2 and 3.

Figure 3:
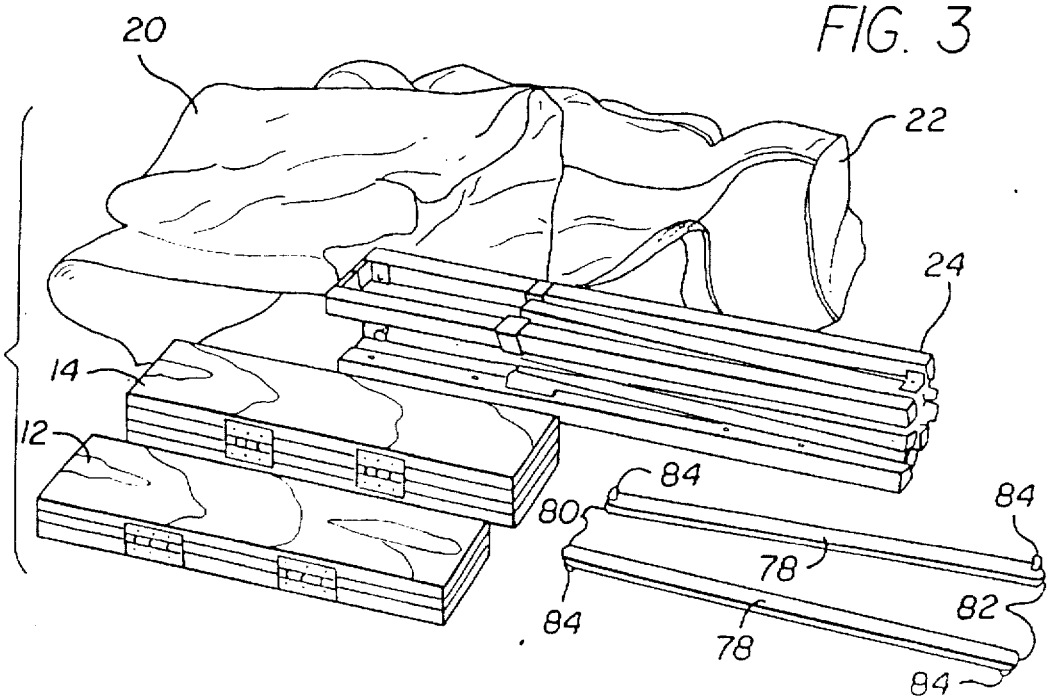
FIG. 3 is a perspective view of the components of the collapsible display table folded, alongside the shroud and duffle bag.
Figure 4:
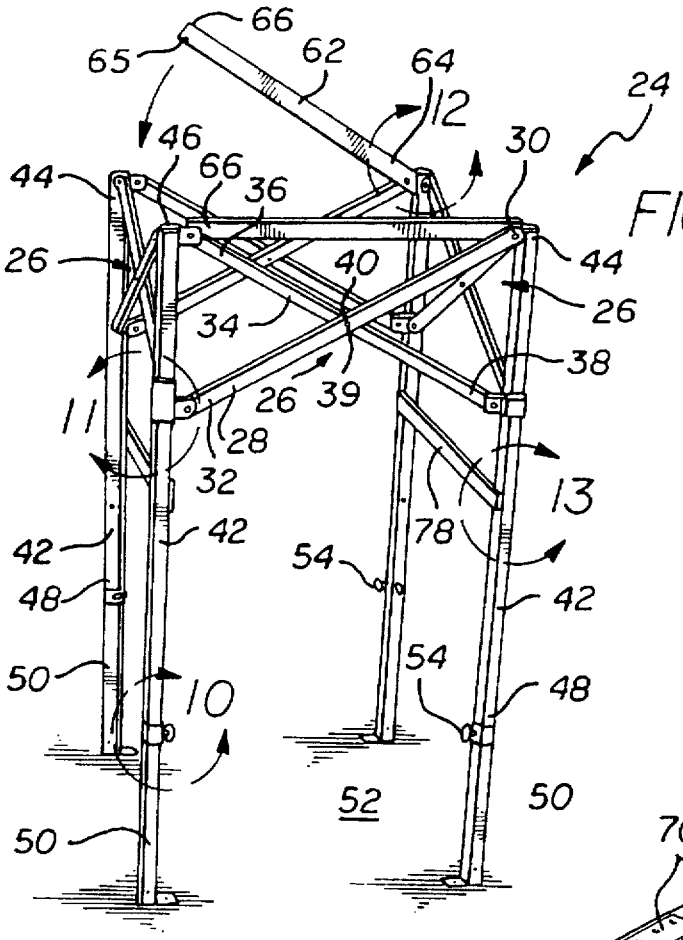
FIG. 4 is a perspective view of the legs and truss pair network of the collapsible display table illustrating placement of the table top support arms.
Figure 5:
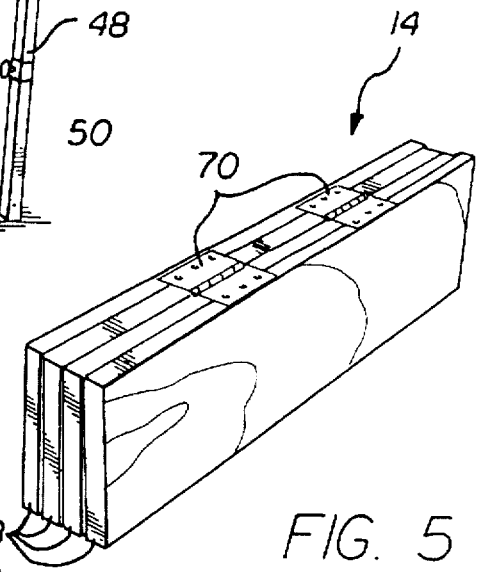
FIG. 5 is a perspective view of the folding table top in a folded configuration.
Figure 6:
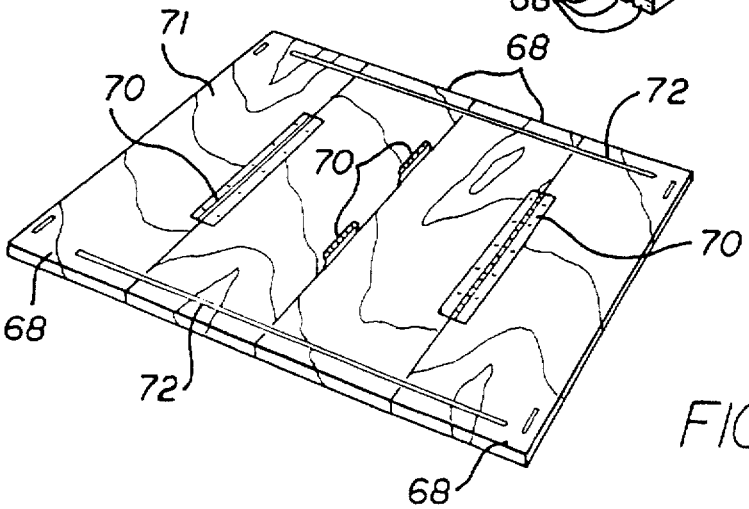
FIG. 6 is a perspective view of the bottom surface of the folding table top in an unfolded configuration.

With reference to FIGS. 3, 4, 9 and 14, in one preferred embodiment, the collapsible display table has a main truss support structure 24, including a plurality of truss pairs 26 of link members. In this embodiment, the collapsible display table preferably has a square table top and four truss pairs of link members, including a first link member 28 having an upper first end 30, and a lower second end 32, and a second link member 34 with an upper first end 36 and a lower second end 38. The first and second link members are pivotally connected together by a pin 39 at the central pivot point 40, in a scissors configuration so as to be extendable horizontally from a first collapsed position as shown in FIG. 3 to a second extended position as shown in FIG. 4. The truss pairs of link members are connected to hollow legs 42 to support the table top and shelf member, as will be further explained below. Each of the legs has an upper end 44 that can be protected with an upper cap 46, and a lower leg end 48 carrying a telescoping foot section 50 slidably disposed within the hollow leg for engagement with the ground 52, or a platform, floor or the like. Each telescoping foot section is slidably mounted within the lower portion of one of the legs, and thumb screws 54 are also mounted to the bottom end of the lower leg portion to secure and stabilize the telescoping foot sections when they are extended. The thumb screws can also be used for retaining the telescoping foot sections in a retracted position within the legs. The upper portion of the telescoping foot section includes a spring loaded detent pin 55 that snaps into position in a corresponding hole 56 in the leg when the telescoping foot section is extended, to automatically lock the foot section in position. A slider member 57 is slidably mounted over each leg. The lower second ends of a first link member on one side of the collapsible display table and a second link member on an adjacent side of the collapsible display table are pivotally connected to each slider member. At least one of the slider members is preferably adapted with a hole 58 for receiving a corresponding detent pin 60 of the leg to which the slider member is mounted for latching the slider member in a fixed position on the leg.

To support the table top and further stabilize the display table once it is set up, the collapsible display table is provided with at least two table top support arms 62, each having first and second ends 64 and 66, respectively. The first ends 64 of each of the table top support arms are pivotally connected to the upper end of one of the legs, and the second ends 66 of each of the table top support arms has a notch 65 so that the table top support arms are removably attachable to a flange or bolt 67 at the upper end of an adjacent one of the legs.

As is shown in FIGS. 3, 5, 6 and 14, the folding table top is made from a plurality of segments 68, such as four segments, for example, that are connected by hinges 70, to allow the table top to be folded. The table top is advantageously provided with a bottom surface 71 with slots 72 dimensioned to interfit with the table top support arms, so that the table top further braces the display table when it is set up. Similarly, as is shown in FIGS. 3, 7, 8 and 14, the lower utility shelf is also made from a plurality of folding segments 74, such as four segments, for example, that are connected by hinges 76, to allow the utility shelf to be folded. As is illustrated in FIGS. 3, 4 and 13, the collapsible display table also includes at least one pair of lower shelf support arms 78, each having first and second ends 80 and 82, respectively, bearing prongs or hooks 84 adapted to fit on opposite sides of the table in corresponding holes 86 in the legs, provided for removably attaching the lower shelf support arms between adjacent legs for supporting the lower shelf. Although the mounting of only one utility shelf is illustrated, additional holes can be provided in the legs for the mounting of additional shelf support arms to provide more shelves for the display table. The bottom surface 88 of the lower shelf also preferably includes slots 90 dimensioned to interfit with the lower shelf support arms, so that the lower shelf further braces the display table when it is set up, as is illustrated in FIG. 14.

For large collapsible display tables, multiple truss pairs of link members can also be provided connecting adjacent legs, with the other elements of the display table being essentially identical to the embodiment described above. For example, in an alternate embodiment illustrated in FIG. 15, adjacent legs can be connected by two truss pairs of link members. In this embodiment, each truss pair 100 and 100' on a side of the collapsible display table includes a first link member 102, 102', and a second link member 104, 104'. The first link member 102 has an inner end 106 pivotally connected to the inner end 106' of the second link member 104' of the other truss pair 100' on the same side. The first link members 102 and 102' also have an outer end 108 and 108' pivotally connected to the upper ends 44 of the adjacent legs on the side. The inner ends 110 and 110' of the second link members are pivotally connected as well, so that the first and second link members of the two truss pairs on a side of the collapsible display table are pivotally connected together in a double scissors configuration so as to be extendable horizontally from a first collapsed position to a second extended position. As in the first embodiment, the outer ends 112 and 112' of the second link members 104 and 104' are pivotally connected to slider members 57 slidably mounted to the legs 42.

In a second alternate embodiment, the collapsible display table of the invention can be constructed with three legs, and have a triangular shaped table top and utility shelf, as is illustrated in FIGS. 16–22. The collapsible display table of this three-legged embodiment is substantially similar to the previous embodiments, and where possible, will be described with like reference numerals for like elements. The telescoping feet, slider member, and shelf support arm configurations are substantially identical to those of the first embodiment, shown in FIGS. 10, 11, and 13.

Figure 16:
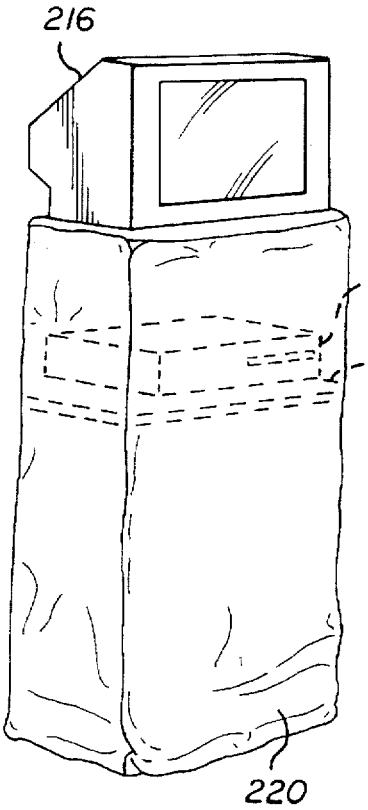
FIG. 16 is a front perspective view of shroud covering a second alternate embodiment of the collapsible display table according to the invention, in which the collapsible table has three legs, with a display monitor resting on the top of the collapsible display table, and accessory equipment resting on the lower shelf of the collapsible display table, shown in phantom.
Figure 23:
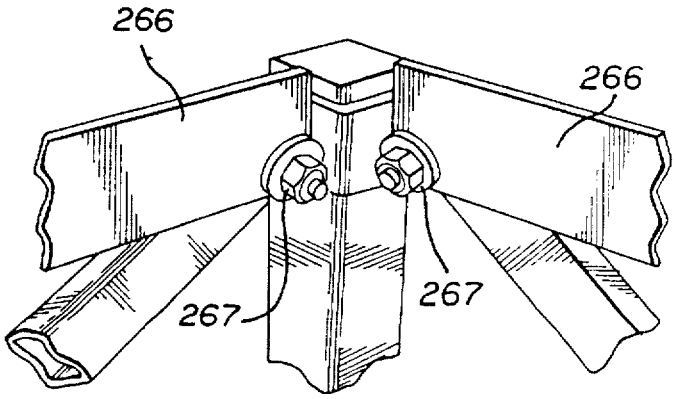
FIG. 23 is an enlarged perspective view of an upper portion of a leg of the collapsible display table of FIG. 16.

In the second alternate embodiment, the collapsible display table 210 preferably also has a lower folding utility shelf 212, and a folding table top 214. The display table is suitable for use in supporting large and heavy display equipment, such as a video display monitor 216, which can be accommodated on the table top. The utility shelf is suitable for supporting accessory equipment, such as a video cassette player 218, computer, CD ROM player, film or slide supplies, and the like. As is illustrated in FIG. 16, the entire collapsible display table can also conveniently be covered, for example, with a fabric shroud 220 to conceal the accessory equipment on the utility shelf, and the structure of the collapsible display table. The table top, utility shelf, and the rest of the structure of the collapsible display table can be readily folded and disassembled for convenient transportation.

Figure 10:
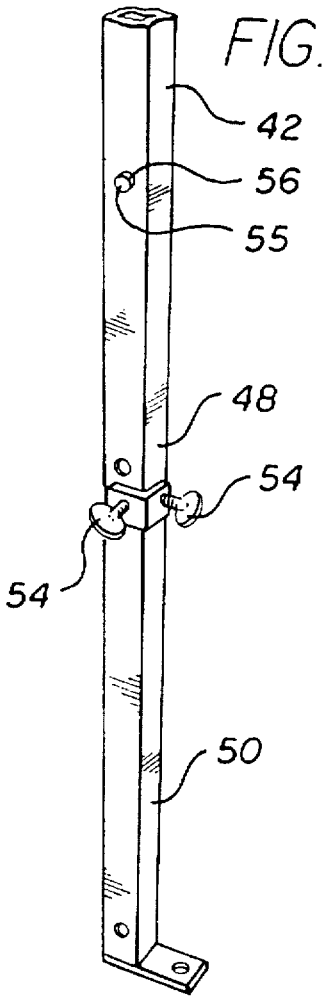
FIG. 10 is an enlarged perspective view of a telescoping foot of a leg of the collapsible display table taken from the inset portion 10 of FIG. 4.
Figure 11:
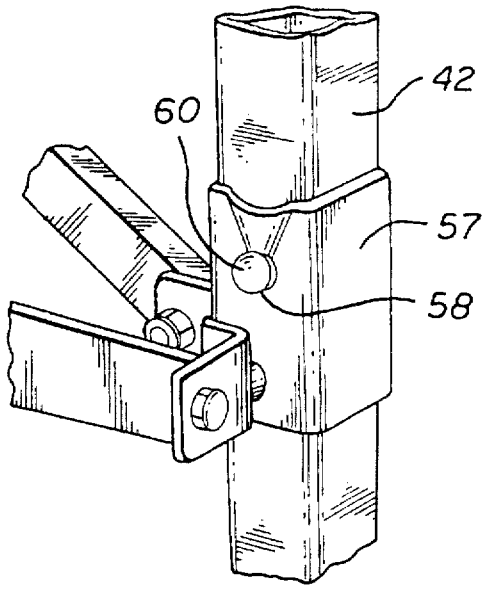
FIG. 11 is an enlarged perspective view of a slider member on a leg of the collapsible display table taken from the inset portion 11 of FIG. 4.
Figure 12:
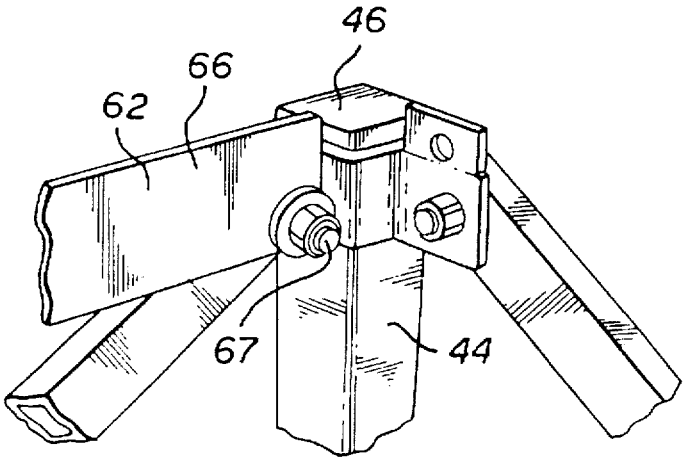
FIG. 12 is an enlarged perspective view of an upper portion of a leg of the collapsible display table taken from the inset portion 12 of FIG. 4.
Figure 17:
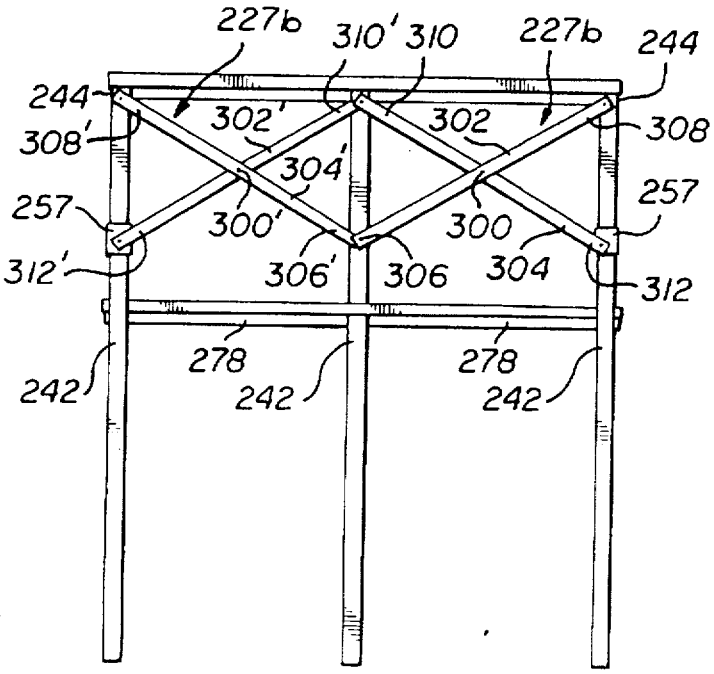
FIG. 17 is a front elevational view of the collapsible display table of FIG. 16, with dual truss pairs of link members on a front side of the collapsible display table.
Figure 18:
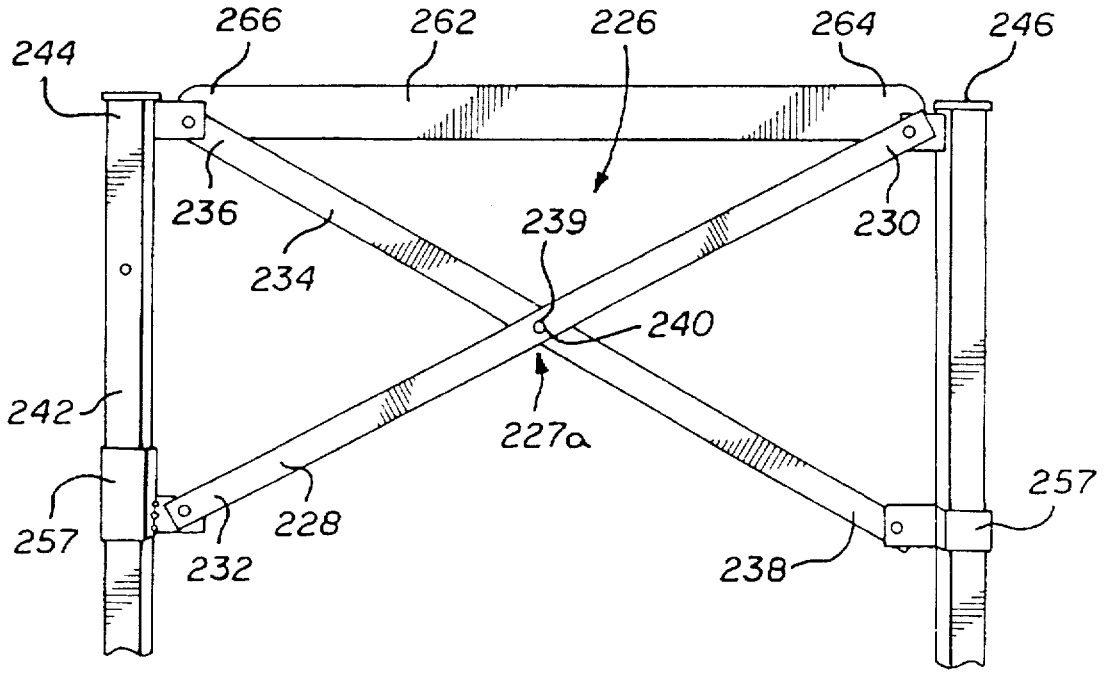
FIG. 18 is a right side elevational view of the collapsible display table of FIG. 16, showing a single truss pair of link members on the right side of the collapsible display table.
Figure 19:
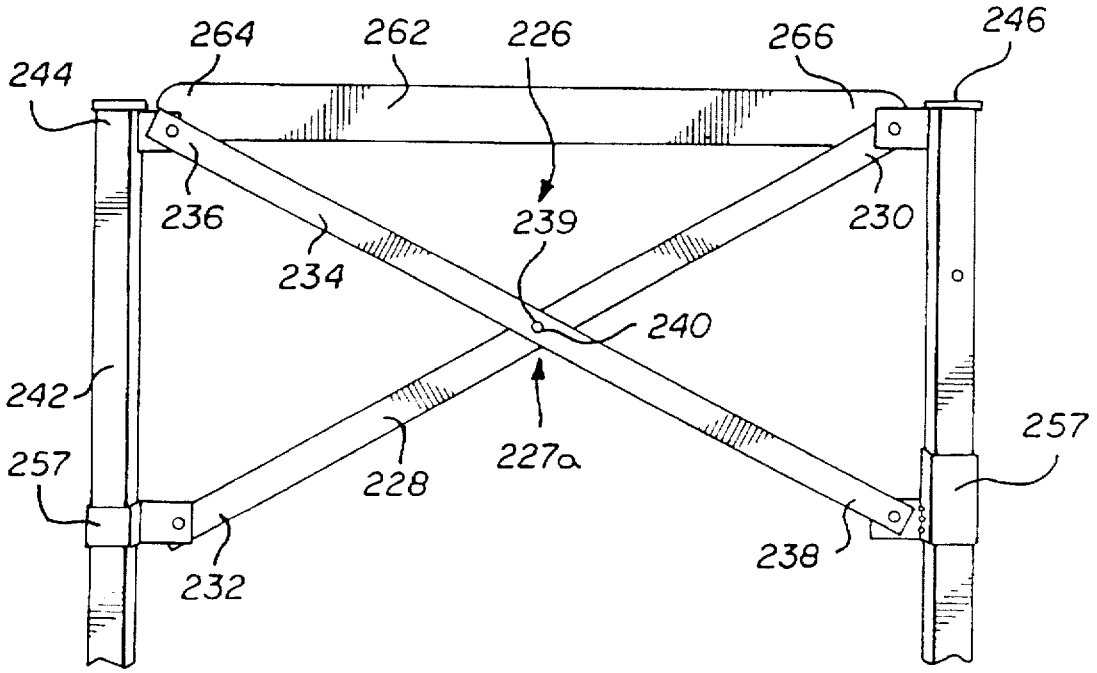
FIG. 19 is a left side elevational view of the collapsible display table of FIG. 16, showing a single truss pair of link members on the left side of the collapsible display table.

With reference to FIGS. 17, 18, and 19, in the second alternate embodiment, the collapsible display table has a main truss support structure 224, including a plurality of truss pairs 226 of link members. In this embodiment, the collapsible display table preferably has a triangular table top and four truss pairs of link members, including two similarly sized side truss pairs **227*a*, and two smaller linked front truss pairs 227*b*. Each side truss pair comprises a first link member 228 having an upper first end 230, and a lower second end 232, and a second link member 234 with an upper first end 236 and a lower second end 238. The first and second link members are pivotally connected together by a pin 239 at the central pivot point 240, in a scissors configuration so as to be extendable horizontally from a first collapsed position to a second extended position, which is illustrated in FIG. 17–19. The truss pairs of link members are connected to hollow legs 242 to support the table top and shelf member. Each of the legs has an upper end 244 that can be protected with an upper cap 246, and as is shown in FIG. 10, a lower leg end carrying a telescoping foot section slidably disposed within the hollow leg for engagement with the ground, or a platform, floor or the like. In this embodiment, although the legs are shown as being square, the legs can also advantageously be triangular. With reference to FIGS. 4, 10 and 11, each telescoping foot section is slidably mounted within the lower portion of one of the legs, and thumb screws can also be mounted to the bottom end of the lower leg portion to secure and stabilize the telescoping foot sections when they are extended. The upper portion of the telescoping foot section includes a spring loaded detent pin that snaps into position in a corresponding hole in the leg when the telescoping foot section is extended, to automatically lock the foot section in position. A slider member 257 is slidably mounted over each leg 242**. The lower second ends of a first link member on one side of the collapsible display table and a second link member on an adjacent side of the collapsible display table are pivotally connected to each slider member. At least one of the slider members is preferably adapted with a hole for receiving a corresponding detent pin of the leg to which the slider member is mounted for latching the slider member in a fixed position on the leg.

As is shown in FIGS. 18 and 19, in order to support the table top and further stabilize the display table once it is set up, the collapsible display table is provided with at least two table top support arms 262, each having first and second ends 264 and 266, respectively. The first ends 264 of each of the table top support arms are pivotally connected to the upper end of one of the legs, and the second ends 266 of each of the table top support arms has a notch so that the table top support arms are removably attachable to a flange or bolt 267 at the upper end of an adjacent one of the legs.

As is best seen in FIG. 17, the pair of smaller trusses **227*b* are linked together on the front side of the collapsible display table of this embodiment, with each front truss pair 300 and 300' on a side of the collapsible display table including a first link member 302, 302', and a second link member 304, 304'. The first link member 302 has an inner end 306 pivotally connected to the inner end 306' of the second link member 304' of the other truss pair 300' on the same side. The first link members 302 and 302' also have an outer end 308 and 308' pivotally connected to the upper ends 244 of the adjacent legs on the side. The inner ends 310 and 310' of the second link members are pivotally connected as well, so that the first and second link members of the two truss pairs on a side of the collapsible display table are pivotally connected together in a double scissors configuration so as to be extendable horizontally from a first collapsed position to a second extended position. As in the first embodiment, the outer ends 312 and 312' of the second link members 304 and 304' are pivotally connected to slider members 257 slidably mounted to the legs 242**.

As is shown in FIGS. 20 and 21, the triangular folding table top is made from a plurality of segments 268, such as three segments, for example, that are connected by hinges 270, to allow the table top to be folded. The table top is advantageously provided with a bottom surface 271 with slots 272 dimensioned to interfit with the table top support arms, so that the table top further braces the display table when it is set up. Similarly, as is illustrated in FIG. 22, the triangular lower utility shelf is also made from a plurality of folding segments 274, such as three segments, for example, that are connected by hinges 276, to allow the utility shelf to be folded. The rear corner 277 of the triangular lower utility shelf is preferably truncated to fit within the display table. As is illustrated in FIG. 17, the collapsible display table also includes at least one pair of lower shelf support arms 278, each having first and second ends, respectively, bearing prongs or hooks as is illustrated in FIG. 13, adapted to fit on opposite sides of the table in corresponding holes in the legs, provided for removably attaching the lower shelf support arms between adjacent legs for supporting the lower shelf. Although the lower shelf support arms 278 are shown in FIG. 17 as being attached to the outside of the legs, they can also be attached to the inside of the legs as illustrated in FIGS. 4 and 14. Although the mounting of only one utility shelf is illustrated, additional holes can be provided in the legs for the mounting of additional shelf support arms to provide more shelves for the display table. The bottom surface 288 of the lower shelf also preferably includes slots 290 dimensioned to interfit with the lower shelf support arms, so that the lower shelf further braces the display table when it is set up.

In light of the above description, it will be apparent that the invention provides for a portable, quickly erectable, collapsible display table having improved stability and strength for supporting large and heavy video display equipment on the table top, and accessory equipment on a lower utility shelf.

It will be apparent from the foregoing that while particular forms of the invention have been illustrated and described, various modifications can be made without departing from the spirit and scope of the invention. Accordingly, it is not intended that the invention be limited, except as by the appended claims.

What is claimed is:

1. A collapsible display table, comprising:

a table top having a bottom surface defining at least two slots;

at least three vertically disposed legs for supporting said table top, each of said legs having an upper end and a lower end;

each of said legs being connected to adjacent ones of said legs by a truss pair of link members, each of said truss pairs including first and second link members having first and second ends, said first link member having a first end connected to the upper end of one said leg, each second link member having a first end slidably connected to said leg, and said first and second link members being pivotally connected together in a scissors configuration so as to be extendable horizontally from a first collapsed position to a second extended position;

at least two pivoting table top support arms each having first and second ends, said at least two pivoting table top supporting arms adapted to interfit with said at least two slots in said table top, said first end of each of said table top support arms being pivotally connected to the upper end of one of said legs, and the second end of each of said table top support arms being removably attached to said upper end of an adjacent one of said legs;

a lower shelf; and at least two shelf support arms each having first and second ends and means for removably attaching said first and second ends of said shelf support arms between adjacent legs for supporting said lower shelf.

2. The collapsible display table of claim 1, wherein said second end of said first link member is slidably connected to a second one of said legs, and said second end of said second link member is pivotally connected to the upper end of said second one of said legs.

3. The collapsible display table of claim 1, wherein said table top comprises a plurality of segments hingedly connected together to be foldable.

4. The collapsible display table of claim 1, wherein said lower shelf comprises a plurality of segments hingedly connected together to be foldable.

5. The collapsible display table of claim 1, wherein said lower shelf has a bottom surface with slots for interfitting with said shelf support arms.

* * * * *